US008316838B2

(12) United States Patent
Ryu et al.

(10) Patent No.: US 8,316,838 B2
(45) Date of Patent: Nov. 27, 2012

(54) BURNER AND COOKING DEVICE

(75) Inventors: Jung Wan Ryu, Changwon (KR); Dae Bong Yang, Changwon (KR); Jea Hyuk Wie, Changwon (KR); Yong Ki Jeong, Changwon (KR); Jae Bum Lim, Changwon (KR); Jun Ho Seok, Changwon (KR); Young Soo Kim, Changwon (KR); Yang Ho Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 140 days.

(21) Appl. No.: 12/761,808

(22) Filed: Apr. 16, 2010

(65) Prior Publication Data

US 2010/0263656 A1 Oct. 21, 2010

(30) Foreign Application Priority Data

Apr. 17, 2009 (KR) ..... 10-2009-0033889
Apr. 17, 2009 (KR) ..... 10-2009-0033891

(51) Int. Cl.
*F24C 3/08* (2006.01)

(52) U.S. Cl. ..... 126/39 E; 126/39 R; 431/353

(58) Field of Classification Search ..... 126/39 E, 126/19 R, 39 R; 431/353, 350, 354
See application file for complete search history.

(56) References Cited

U.S. PATENT DOCUMENTS

| | | | | |
|---|---|---|---|---|
| 2,300,156 | A * | 10/1942 | Higley | 431/44 |
| 2,560,777 | A * | 7/1951 | Reeves | 431/286 |
| 2004/0107958 | A1 * | 6/2004 | Paul, III | 126/512 |

FOREIGN PATENT DOCUMENTS

| | | | |
|---|---|---|---|
| JP | 1-302013 | A | 12/1989 |
| KR | 1991-0007529 | Y1 | 9/1991 |
| KR | 0133637 | Y1 | 3/1999 |
| KR | 2000-97409 | A | 4/2000 |
| KR | 10-0844124 | B1 | 6/2008 |
| KR | 10-2010-0013336 | A | 2/2010 |

OTHER PUBLICATIONS

English-Language Abstract for KR 20-0133637-Y1; reference KR 20-0133637-Y1 was previously filed on Jul. 7, 2011.
English-Language Abstract for KR 20-1991-0007529-Y1; reference KR 20-1991-0007529-Y1 was previously filed on Jul. 7, 2011.

* cited by examiner

*Primary Examiner* — Alfred Basichas
(74) *Attorney, Agent, or Firm* — Birch, Stewart, Kolasch & Birch, LLP

(57) ABSTRACT

A cooking device is provided. The cooking device includes a cavity and a burner. The cavity provides a cooking chamber. The burner is at the cooking chamber in the cavity and heats food in the cooking chamber. The burner includes a supply part and a combustion unit. A gaseous fuel mixed with air flows in the supply part. The combustion unit is connected to the supply part to receive the mixed gaseous fuel and to burn the received mixed gaseous fuel flowing within the combustion unit. The combustion unit has a single loop shape.

15 Claims, 11 Drawing Sheets

BURNER AND COOKING DEVICE

CROSS-REFERENCE TO RELATED APPLICATIONS

The present application claims priority under 35 U.S.C. 119 and 35 U.S.C. 365 to Korean Patent Application No. 10-2009-0033889 (filed on 17 Apr., 2009), and Korean Patent Application No. 10-2009-0033891 (filed on 17 Apr., 2009), which are hereby incorporated by reference in its entirety.

BACKGROUND

The present disclosure relates to a burner and a cooking device.

Cooking devices are used for heating foods using a heat source such as a burner that generates heat by burning a gaseous fuel.

Such a burner includes a plurality of flame holes for burning a gaseous fuel, and the flame holes are spaced a predetermined distance from each other.

SUMMARY

Embodiments provide a burner and a cooking device that are configured to uniformly heat food.

In one embodiment, a cooking device includes: a cavity providing a cooking chamber; and a burner at the cooking chamber in the cavity, the burner heating food in the cooking chamber, and the burner includes: a supply part where a gaseous fuel mixed with air flows; and a combustion unit connected to the supply part to receive the mixed gaseous fuel and to burn the received mixed gaseous fuel flowing within the combustion unit, and the combustion unit has a single loop shape.

In another embodiment, a burner includes: a supply part where a gaseous fuel mixed with air flows; and a combustion unit connected to the supply part to receive the mixed gaseous fuel and to burn the received mixed gaseous fuel flowing within the combustion unit, and the combustion unit includes an inner part provided with a plurality of flame holes, and an outer part provided with a plurality of flame holes, and the mixed gaseous fuel flows between the inner and outer parts.

In further another embodiment, a burner includes: a first combustion part provided with at least one flame hole to receive a gaseous fuel mixed with air and to burn the mixed gaseous fuel; and a second combustion part connected to the first combustion part to receive the mixed gaseous fuel and provided with one or more flame holes to burn the mixed gaseous fuel, and the second combustion part has a single loop shape.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
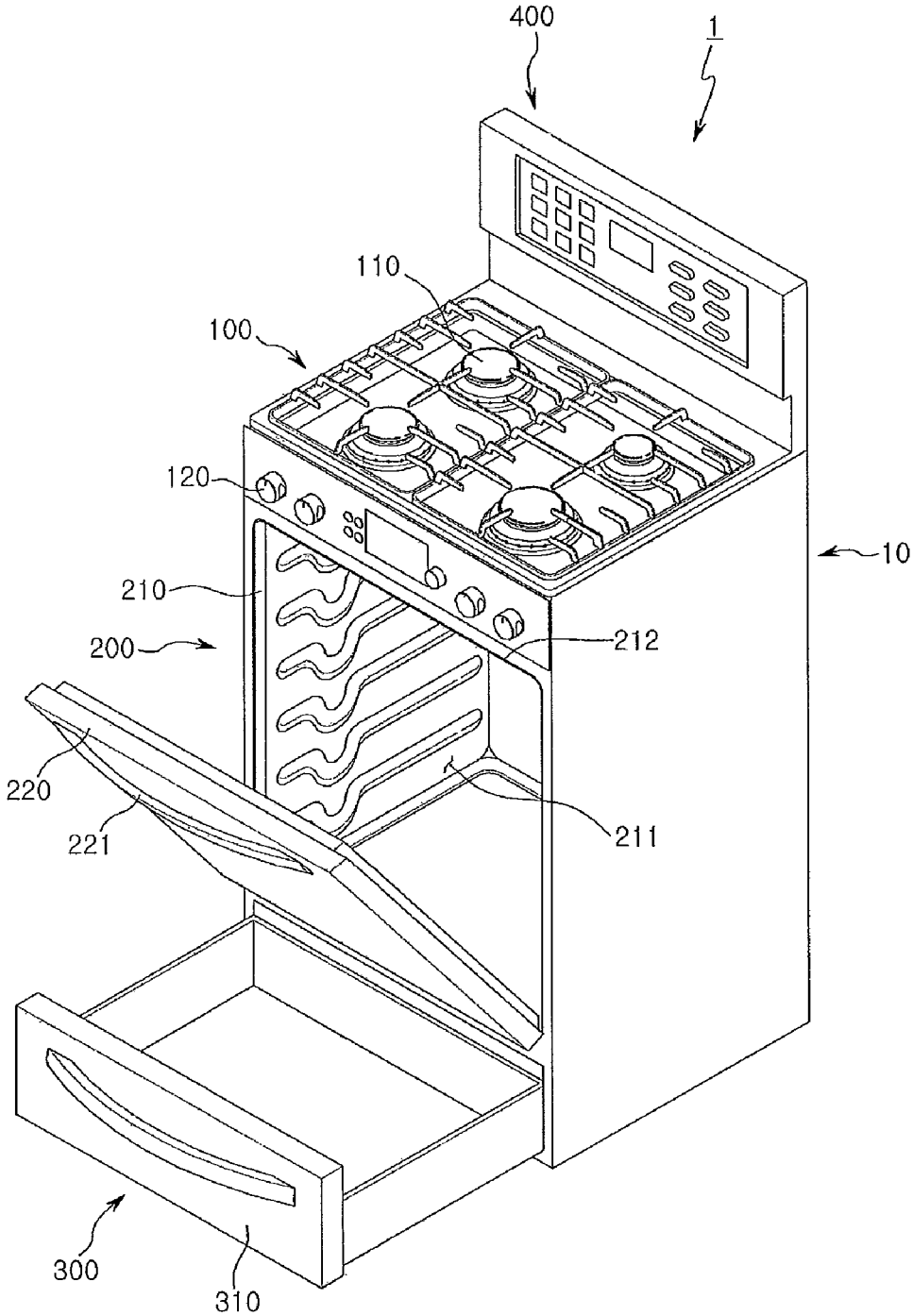
FIG. 1 is a perspective view illustrating a cooking device according to an embodiment.
Figure 2:
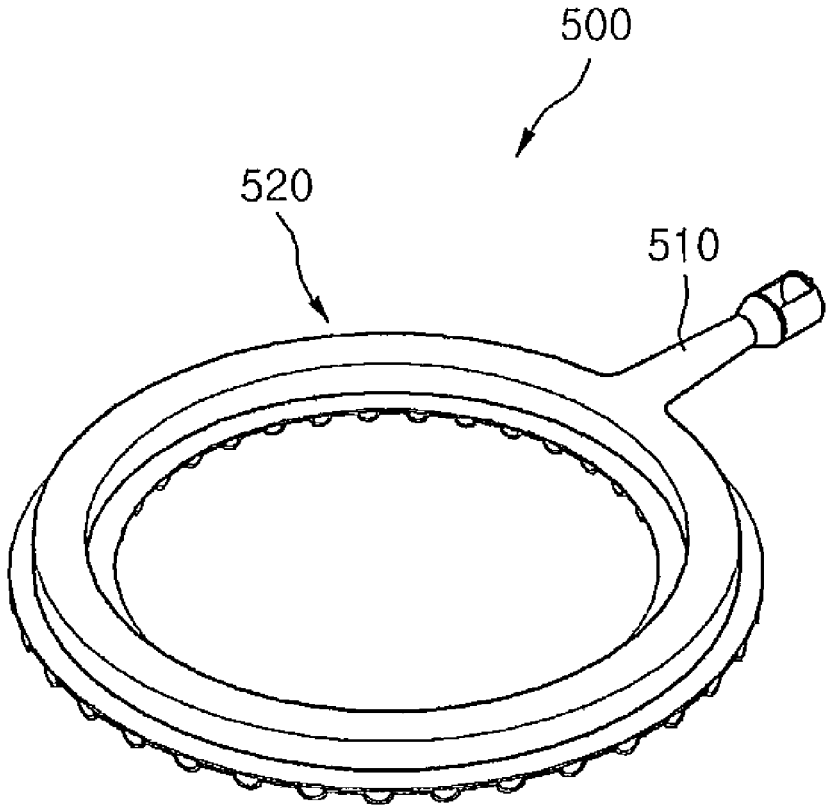
FIG. 2 is a perspective view illustrating an oven burner of the cooking device of FIG. 1.

FIG. 1 is a perspective view illustrating a cooking device 1 according to an embodiment, and FIG. 2 is an exploded perspective view illustrating an oven burner 500 of the cooking device 1.

Referring to FIGS. 1 and 2, the cooking device 1 includes a cook top part 100, an oven part 200, a drawer part 300, and a control part 400.

The cook top part 100, the oven part 200, and the drawer part 300 are disposed at upper, middle, and lower regions of a main body 10 of the cooking device 1, respectively. The control part 400 is disposed on the top of the main body 10 at a rear edge portion corresponding to a rear side of the cook top part 100.

In more detail, the cook top part 100 includes a plurality of cook-top burners 110. Each of the cook-top burners 110 can generate a flame by burning a gaseous fuel to directly heat a container in which food is placed. A plurality of knobs 120 are disposed on a front end portion of the cook top part 100. The knobs 120 are used to close, open, or adjust valves (not shown) for starting, stopping, or adjusting supply of a gaseous fuel to the cook-top burners 110.

The oven part 200 includes a cavity 210 that provides a cooking chamber 211 for cooking food. The oven burner 500 is disposed in the cavity 210 to heat food in the cooking chamber 211. Other than the oven burner 500, an additional heat source (not shown) may be provided within or without the cavity 210 to heat food in the cooking chamber 211.

The cooking chamber 211 can be selectively closed and opened by using a door 220. The door 220 is a pull-down door of which the top end can be rotated up and down about the lower end. A handle 221 is provided on a front upper portion of the door 220 so that a user can easily rotate the door 220 using the handle 221.

A container in which food is contained can be stored in the drawer part 300 at a predetermined temperature. The drawer part 300 includes a drawer 310 in which a container can be placed.

A manipulation signal can be input (generated) through the control part 400 for operating the cooking device 1, specifically, at least one of the cook top part 100, the oven part 200, and the drawer part 300. In addition, the control part 400 displays information about operational conditions of the cooking device 1.

The oven burner 500 is disposed on an inner upper side of the cavity 210. The oven burner 500 is used to burn a gaseous fuel to directly heat food placed in the cooking chamber 211 by radiant heat.

A reflector (not shown) may be disposed between a ceiling 212 of the cavity 210 and the oven burner 500.

When a gaseous fuel is burned at the oven burner 500, the reflector reflects flames and heat downwardly toward food placed in the cooking chamber 211.

Figure 3:
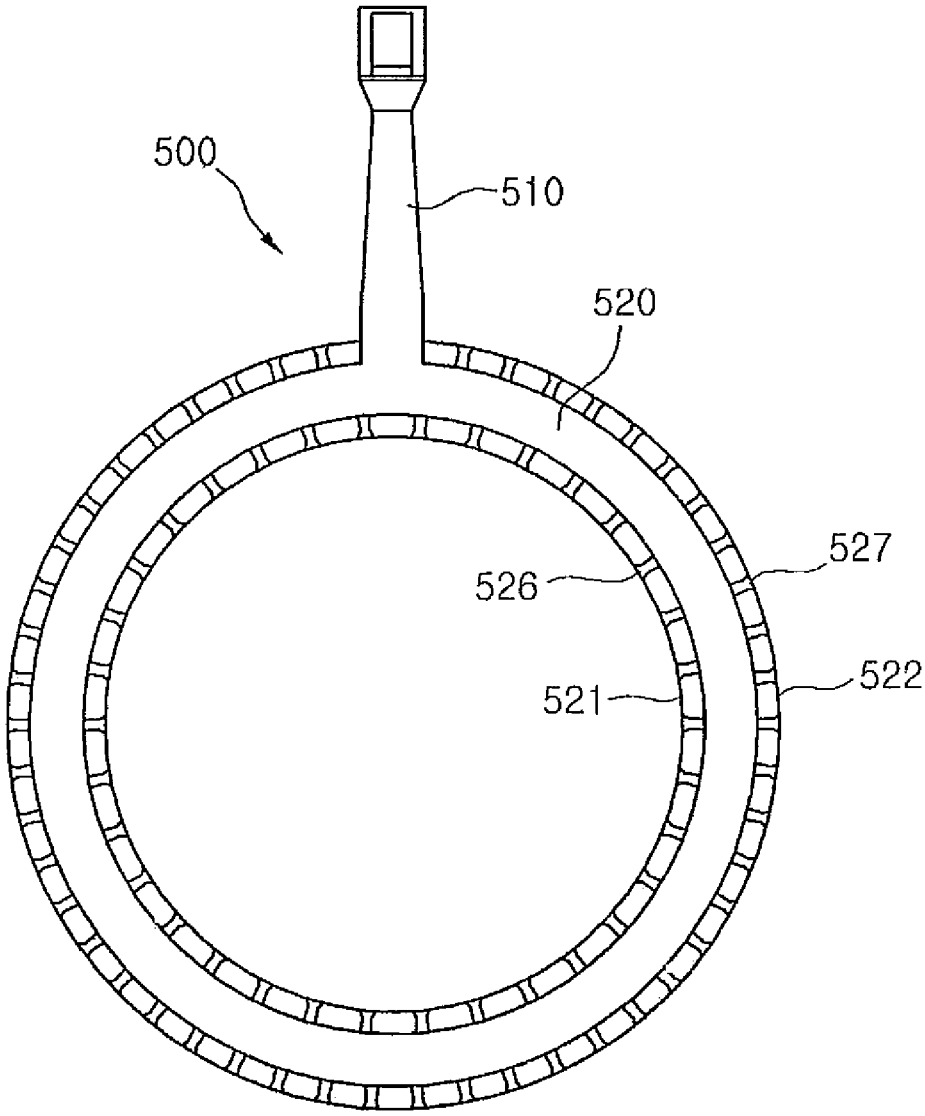
FIG. 3 is a bottom view illustrating the oven burner of FIG. 2.
Figure 4:
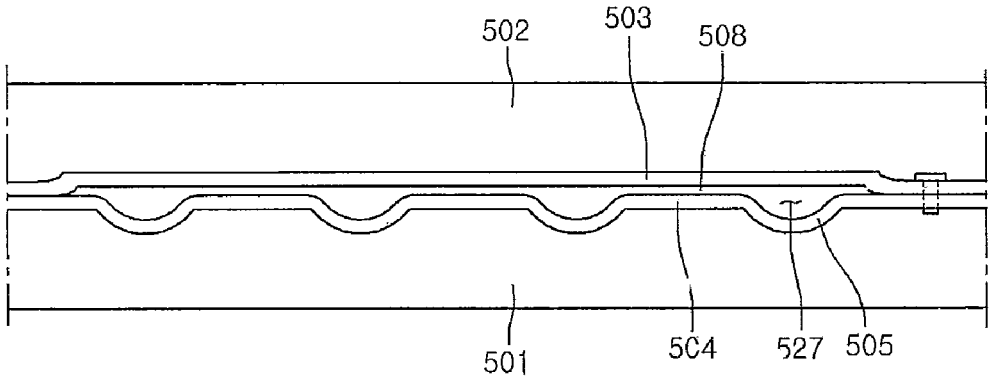
FIG. 4 is a side view illustrating flame holes of the oven burner of FIG. 2.
Figure 5:
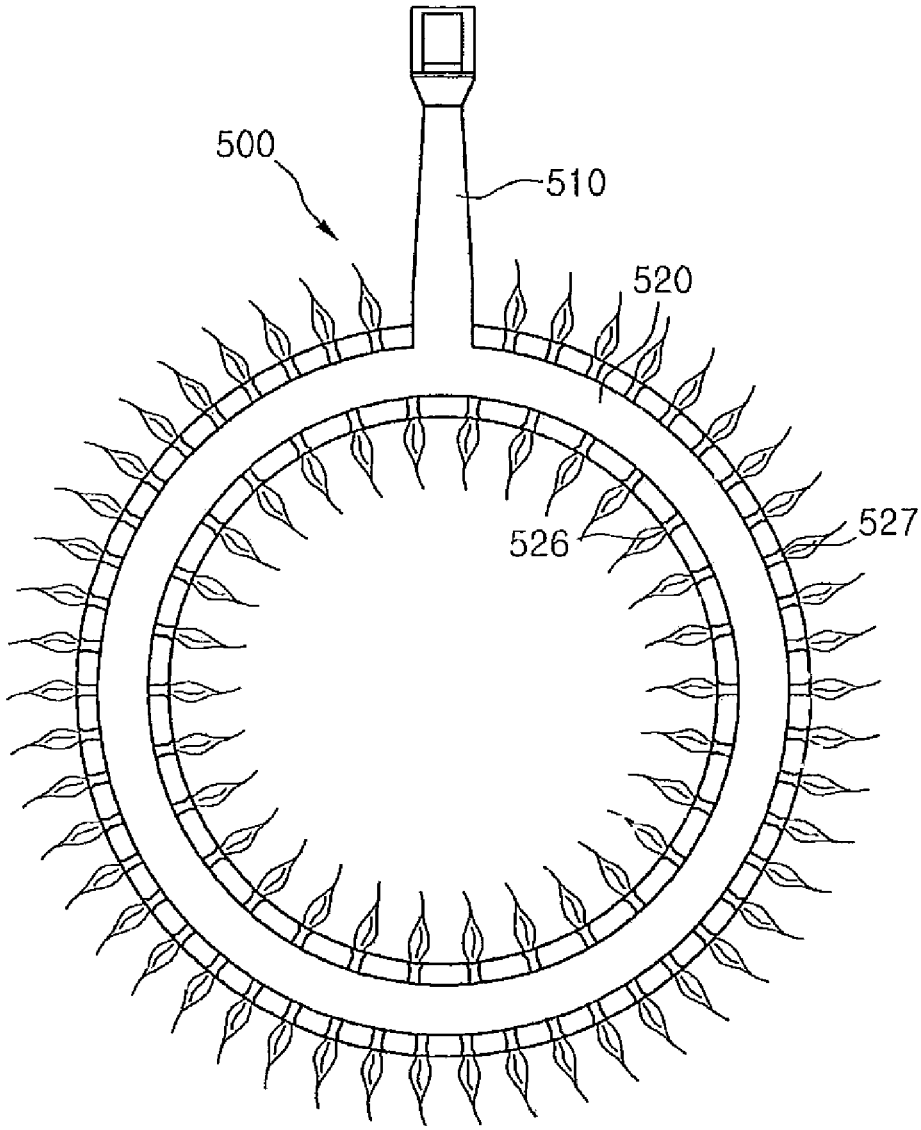
FIG. 5 is a bottom view illustrating flames generated from the oven burner of FIG. 2.

FIG. 3 is a bottom view illustrating the oven burner 500. FIG. 4 is a side view illustrating flame holes 526 and 527 of the oven burner 500. FIG. 5 is a bottom view illustrating flames generated from the oven burner 500.

Referring to FIGS. 2 to 5, the oven burner 500 includes a supply part 510 supplying a gaseous fuel mixed with air, and a combustion unit 520 receiving the mixed gaseous fuel from the supply part 510 to burn the mixed gaseous fuel.

The supply part 510 provides the combustion unit 520 with a gaseous fuel supplied from a nozzle (not shown), and air supplied together with the gaseous fuel. The supply part 510 horizontally extends from the combustion unit 520.

The supply part 510 may pass through a sidewall of the cavity 210, or the nozzle may pass through the sidewall of the cavity 210. The supply part 510 is aligned with the nozzle in the state where the supply part 510 is spaced apart from the nozzle. The supply part 510 may have at least one straight portion.

The combustion unit 520 is horizontally disposed within the cavity 210.

The combustion unit 520 is round as a whole. For example, the combustion unit 520 may be circular or oval. That is, the combustion unit 520 has a single loop shape (or closed curve shape).

The combustion unit 520 includes an inner part 521 and an outer part 522. The inner part 521 and the outer part 522 are provided with the flame holes 526 and 527 for generating flames, respectively. Alternatively, a single flame hole may be provided to each of the inner part 521 and the outer part 522. Accordingly, a gaseous fuel mixed with air flows between the inner part 521 and the outer part 522, and spreads into the flame holes 526 and 527.

Since the periphery of the inner part 521 is less than the periphery of the outer part 522, a distance between the flame holes 526 of the inner part 521 may be greater than distances between the flame holes 527 of the outer part 522 to prevent interference between flames that are generated from the flame holes 526 of the inner part 521.

The mixed gaseous fuel supplied to the combustion unit 520 through the supply part 510 is branched in both side directions. Since the combustion unit 520 has a single loop shape, branched portions of the mixed gaseous fuel meet each other again.

Thus, the combustion unit 520 includes a first branch and a second branch that are symmetrical with respect to a portion of the combustion unit 520 connected with the supply part 510. The first and second branches are connected to each other through their both ends, and are symmetrical with respect to an imaginary line extending from the supply part 510.

A heating capacity of the combustion unit 520 may vary according to the size of the cavity 210. When the cavity 210 is small, the combustion unit 520 may be small.

When the combustion unit 520 is small, the mixed gaseous fuel in the first branch may interfere with the mixed gaseous fuel in the second branch. The combustion unit 520 may include a compartment part that divides an inner passage. The compartment part may be disposed in a connection portion of the branches.

According to the embodiment, since the inner part and the outer part generate flames, the areas of the flames are increased to quickly heat food.

In addition, since a flame is not generated in the middle of the combustion unit, heat is prevented from being collected in the middle of food.

Referring to FIG. 4, the combustion unit 520 includes a lower case 501 and an upper case 502. Only the flame holes 527 of the outer part 522 are exemplified since the flame holes 526 have the same structure as the flame holes 527.

For example, the lower case 501 may be coupled to the upper case 502 through a screw. Alternatively, the lower case 501 may be coupled to the upper case 502 through a rivet. However, the coupling of the lower case 501 and the upper case 502 is not limited thereto.

At least one of the lower case 501 and the upper case 502 is provided with a plurality of flame hole forming regions 505 for forming the flame holes 527. In the present embodiment, the lower case 501 is provided with the flame hole forming regions 505.

The flame hole forming regions 505 are formed by partially processing the lower case 501. Adjacent two of the flame hole forming regions 505 are connected through a connection region 504.

When the lower case 501 is coupled to the upper case 502, a gap 508 for transferring a flame is disposed between at least adjacent two of the flame holes 527. That is, the lower case 501 is spaced apart from the upper case 502 except for a region where the upper case 502 is coupled to the lower case 501. To space the lower case 501 apart from the upper case 502, a gap forming region 503 may be provided to the upper case 502. When the upper case 502 is provided with the flame hole forming regions 505, the gap forming region 503 may be provided to the lower case 501.

That is, when the lower case 501 is coupled to the upper case 502, the connection region 504 is spaced apart from the gap forming region 503 that faces the connection region 504.

The vertical distance of the gap 508 is less than those of the flame holes 527.

According to the present embodiment, the gap 508 efficiently transfers a flame between at least adjacent two of the flame holes 527.

Particularly, even when the oven burner 500 is in a low operation mode (where flames are weak), flames can be efficiently transferred between the flame holes 527.

Since a flame is efficiently transferred between the flame holes 527, flame intensities (flame hole load) of the flame holes 527 are substantially uniform, so as to uniformly heat food.

Hereinafter, operation of the cooking device 1 will now be described.

A user inputs a manipulation signal by using the control part 400 for cooking food using the oven part 200. If a manipulation signal is input through the control part 400, at least the oven burner 500 is operated to cook food in the cooking chamber 211.

Particularly, when a gaseous fuel is introduced into the supply part 510 from the nozzle, air around the supply part 510 is introduced into the supply part 510.

Then, the gaseous fuel and the air introduced into the supply part 510 are mixed while flowing along the supply part 510. The gaseous fuel mixed with the air flows to the burning unit 520 to generate flames at the flame holes 526 and 527.

Thus, the flames at the flame holes 526 and 527 directly heat food in the cooking chamber 211 by radiant heat.

Figure 6:
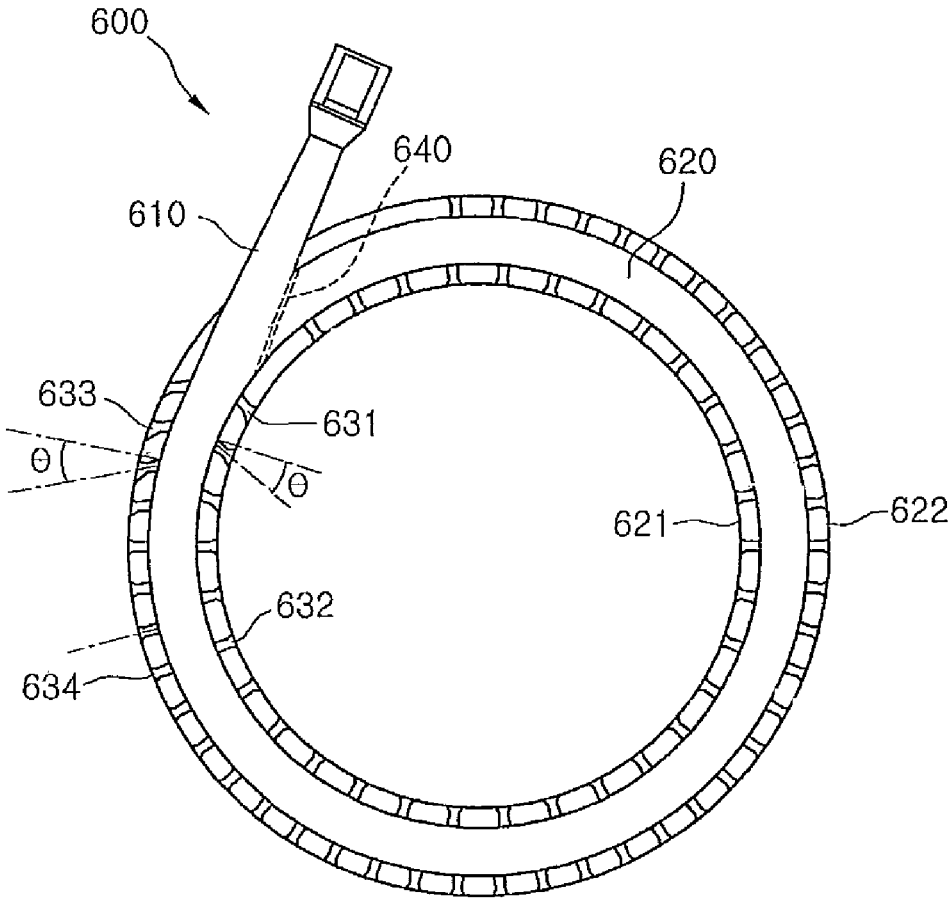
FIG. 6 is a bottom view illustrating an oven burner according to another embodiment.

FIG. 6 is a bottom view illustrating an oven burner 600 according to another embodiment.

Referring to FIG. 6, the oven burner 600 includes a supply part 610 and a combustion unit 620.

The combustion unit 620 may be circular or oval like the previous embodiment.

The combustion unit 620 includes an inner part 621 and an outer part 622. The inner part 621 is provided with first and second flame holes 631 and 632 for generating flames. The outer part 622 is provided with first and second flame holes 633 and 634 for generating flames. Alternatively, each of the inner part 621 and the outer part 622 may be provided with a single flame hole.

Since the periphery of the inner part 621 is less than the periphery of the outer part 622, a distance between the first and second flame holes 631 and 632 of the inner part 621 may be greater than a distance between the first and second flame holes 633 and 634 of the outer part 622 to prevent interference between flames that are generated from the first and second flame holes 631 and 632 of the inner part 621.

The supply part 610 is connected to the combustion unit 620 in a tangential direction of the combustion unit 620, so as to quickly spread a mixed gaseous fuel from the supply part 610 to the combustion unit 620.

To prevent a mixed gaseous fuel disposed in the combustion unit 620 from interfering with a mixed gaseous fuel supplied from the supply part 610 to the combustion unit 620, the combustion unit 620 is provided with a compartment part 640 for dividing an inner space of the combustion unit 620.

The compartment part 640 may be adjacent to a portion of the supply part 610 connected to the combustion unit 620.

The first flame holes 631 are distinguished from the second flame holes 632 by a flow direction of a mixed gaseous fuel introduced into the combustion unit 620.

The second flame holes 632 are normal to a side surface of the combustion unit 620. That is, the second flame holes 632 are normal to the periphery of the combustion unit 620.

Since the first flame holes 631 are adjacent to the supply part 610, if the first flame holes 631 are normal to the periphery of the combustion unit 620, it is difficult for a mixed gaseous fuel to efficiently flow. Thus, the first flame holes 631 are tilted from the normal direction to the side surface of the combustion unit 620 to efficiently introduce a mixed gaseous fuel in the tangential direction of the combustion unit 620.

The first flame holes 633 are distinguished from the second flame holes 634 by a flow direction of a mixed gaseous fuel introduced into the combustion unit 620.

The second flame holes 634 are normal to the side surface of the combustion unit 620. That is, the second flame holes 634 are perpendicular to the combustion unit 620.

Since the first flame holes 633 are adjacent to the supply part 610, if the first flame holes 633 are perpendicular to the periphery of the combustion unit 620, it is difficult for a mixed gaseous fuel to efficiently flow. Thus, the first flame holes 633 are tilted from the normal direction to the side surface of the combustion unit 620 to efficiently introduce a mixed gaseous fuel in the tangential direction of the combustion unit 620.

According to the present embodiment, a mixed gaseous fuel efficiently flows into the combustion unit.

Figure 7:
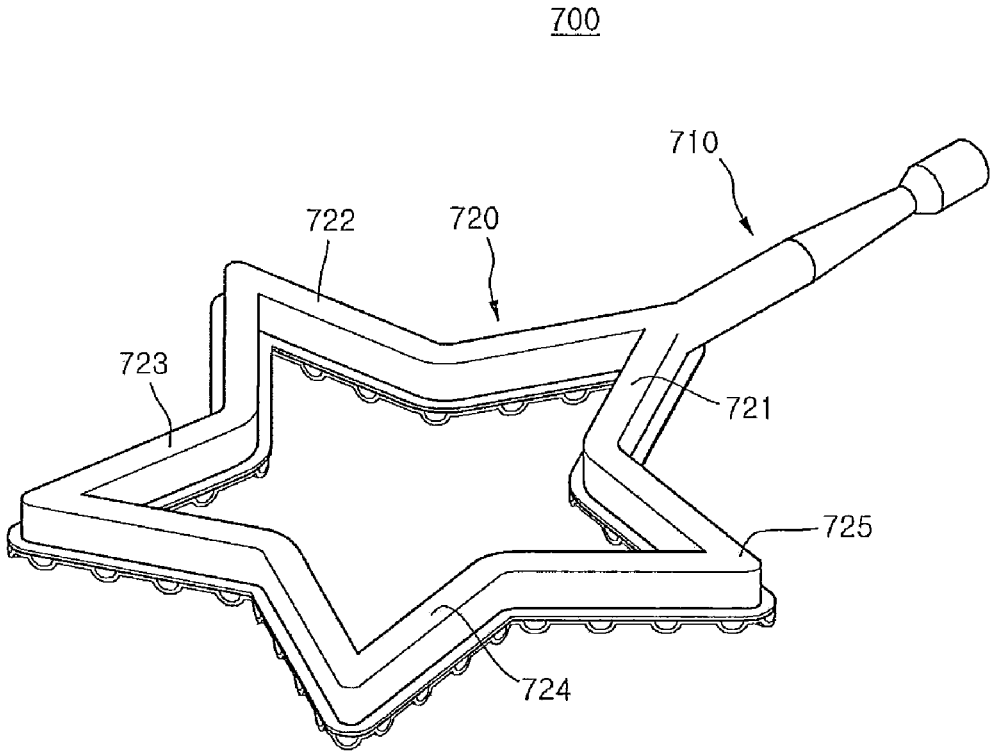
FIG. 7 is a perspective view illustrating an oven burner according to another embodiment.
Figure 8:
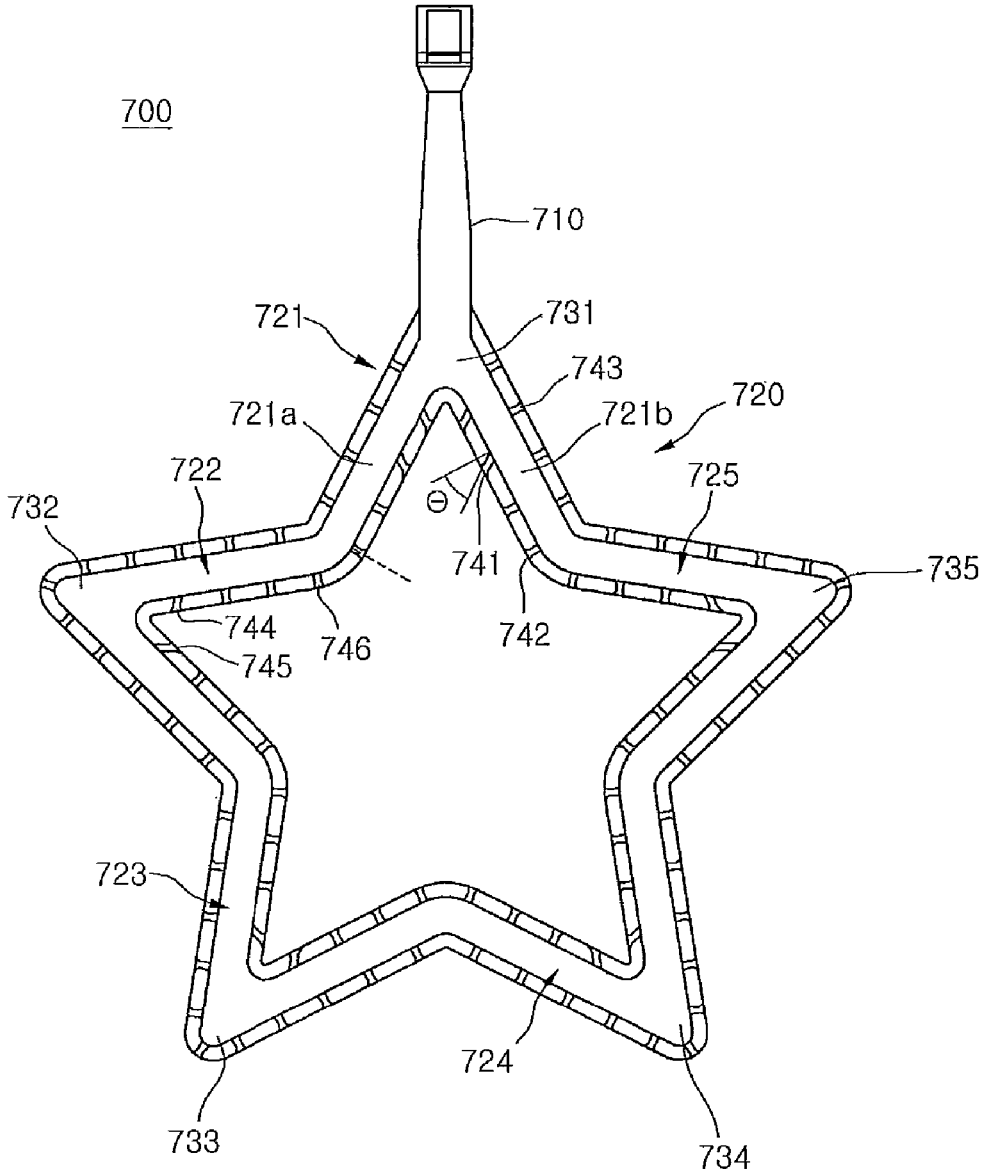
FIG. 8 is a bottom view illustrating the oven burner of FIG. 7.

FIG. 7 is a perspective view illustrating an oven burner 700 according to another embodiment. FIG. 8 is a bottom view illustrating the oven burner 700.

Referring to FIGS. 7 and 8, the oven burner 700 includes a supply part 710 supplying a gaseous fuel mixed with air, and a combustion unit 720 receiving the mixed gaseous fuel from the supply part 710 to burn the mixed gaseous fuel.

The supply part 710 provides a gaseous fuel supplied from a nozzle (not shown) and air supplied together with the gaseous fuel, to the combustion unit 720. The supply part 710 horizontally extends from the combustion unit 720.

The supply part 710 may pass through the sidewall of the cavity 210, or the nozzle may pass through the sidewall of the cavity 210. The supply part 710 is aligned with the nozzle in the state where the supply part 710 is spaced apart from the nozzle.

The combustion unit 720 includes first through fifth combustion parts 721, 722, 723, 724, and 725. Both ends of one of the first through fifth combustion parts 721, 722, 723, 724, and 725 are connected to ends of other of the first through fifth combustion parts 721, 722, 723, 724, and 725. Thus, the combustion unit 720 has a single loop shape (closed curve shape).

Each of the first through fifth combustion parts 721, 722, 723, 724, and 725 is bent at least one time. That is, the first through fifth combustion parts 721, 722, 723, 724, and 725 include bent portions 731, 732, 733, 734, and 735, respectively.

Thus, the combustion unit 720 has a star shape in a plan view. One of the first through fifth combustion parts 721, 722, 723, 724, and 725 may be connected to the supply part 710. In the present embodiment, the first combustion part 721 is connected to the supply part 710.

In this case, a mixed gaseous fuel introduced into the first combustion part 721 is distributed in both directions. The combustion unit 720 is symmetrical with respect to an imaginary line extending from the supply part 710.

The combustion unit 720 is disposed horizontally within the cavity 210, and the supply part 710 extends horizontally from the combustion unit 720.

Each of the first through fifth combustion parts 721, 722, 723, 724, and 725 includes an inner portion and an outer portion. At least one flame hole is provided to each of the inner and outer portions. In the present embodiment, a plurality of outer flame holes 743 are provided to each of the outer portions, and a plurality of flame holes are provided to each of the inner portions.

The outer flame holes 743 provided to the outer portions are normal to the first through fifth combustion parts 721, 722, 723, 724, and 725.

The flame holes provided to the inner portion in the first combustion part 721 include first inner flame holes 741 tilted from a normal direction to a side surface of the burning unit 720, and second inner flame holes 742 normal to the side surface of the burning unit 720.

Hereinafter, the arrangement of the first inner flame holes 741 and the second inner flame holes 742 will now be described.

The first combustion part 721 is branched in both directions with respect to the bent portion 731. That is, the first combustion part 721 includes a first branch 721*a* and a second branch 721*b*. At least one of the first inner flame holes 741 is provided to each of the first and second branches 721*a* and 721*b* and is adjacent to the bent portion 731. The second inner flame holes 742 are disposed in a single line on each of the sides of the first inner flame holes 741.

The inner portions of the first inner flame holes 741 of the first and second branches 721*a* and 721*b* are tilted toward the second inner flame holes 742 (or in a direction away from the bent portion 731) to prevent flames adjacent to the bent portion 731 from interfering with each other in the first and second branches 721*a* and 721*b*.

The flame holes, provided to each of the inner portions in the second through fifth combustion parts 722, 723, 724, and 725, include at least one first flame hole 744, at least one second inner flame hole 745, and a plurality of third inner flame holes 746. The first and second flame holes 744 and 745 are tilted from the normal direction to the side surface of the burning unit 720. The third inner flame holes 746 are normal to the side surface of the burning unit 720.

Hereinafter, the flame holes of the second combustion part 722 will now be described. Since the flame holes of the third through fifth combustion parts 723, 724, and 725 are the same as the flames holes of the second combustion part 722, descriptions thereof will be omitted.

The first and second inner flame holes 744 and 745 are adjacent to the bent portion 732 of the second combustion part 722.

The third inner flame holes 746 are parallel to each other and disposed away from the bent portion 732, relative to the first and second inner flame holes 744 and 745.

The inner portion of the first flame hole 744 is tilted toward the bent portion 732, and the inner portion of the second inner flame hole 745 is tilted away from the bent portion 732, so as to prevent flames from interfering with each other at the bent portion 732.

According to the present embodiment, since flames are generated at the outer and inner portions of the combustion unit 720, the areas of the flames are increased to quickly heat food. In addition, since a flame is not generated in the middle of the combustion unit 520, heat is prevented from being collected in the middle of food.

In addition, the combustion parts are bent to increase flame areas. In addition, the flame holes adjacent to the bent portions in the branches are tilted from the normal direction to the side surface of the combustion unit, so as to prevent flame interference at the bent portions.

In the present embodiment, the number of the combustion parts constituting the combustion unit is five, but is not limited thereto.

Figure 9:
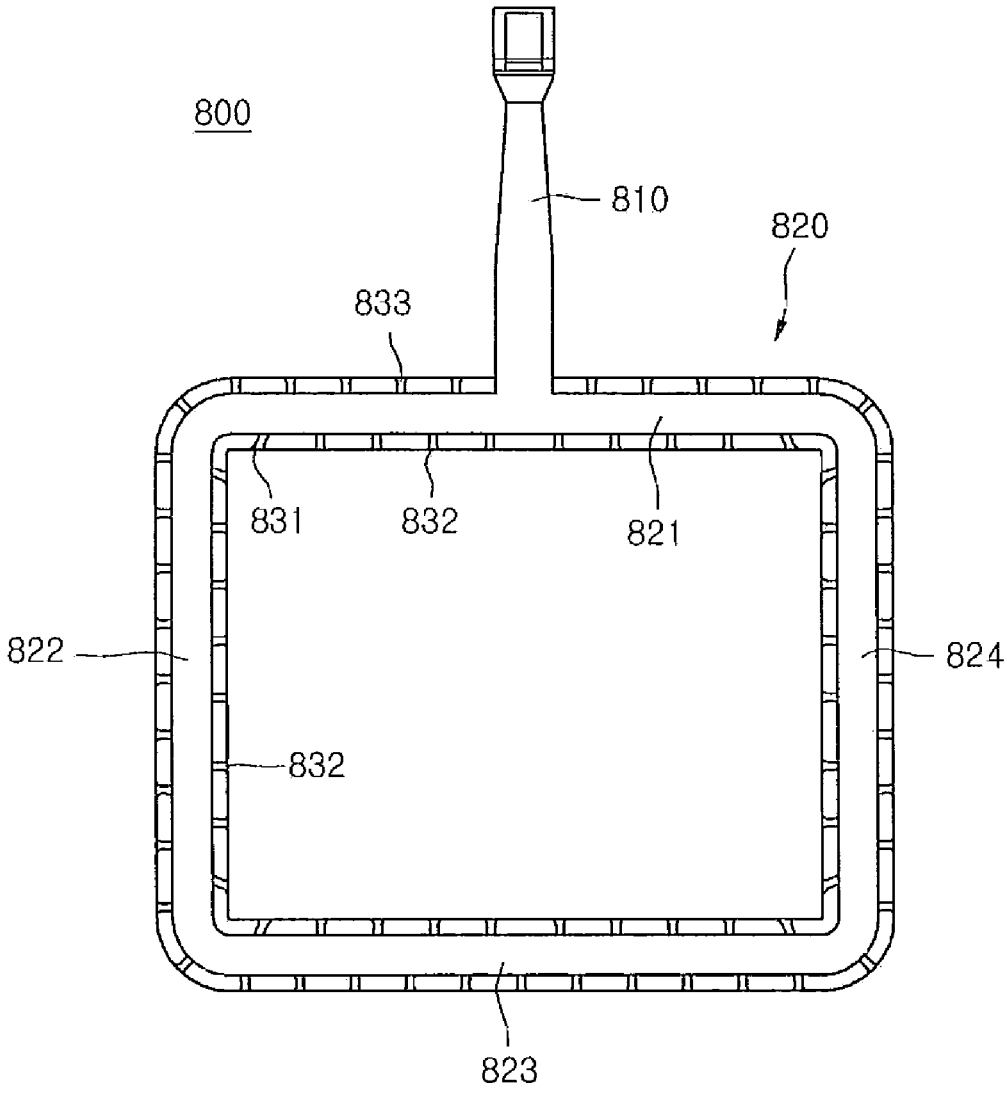
FIG. 9 is a bottom view illustrating an oven burner according to another embodiment.

FIG. 9 is a bottom view illustrating an oven burner 800 according to another embodiment.

Referring to FIG. 9, the oven burner 800 includes a supply part 810 and a combustion unit 820.

The combustion unit 820 includes first through fourth combustion parts 821, 822, 823, and 824, each of which has at least one straight shape.

The first through fourth combustion parts 821, 822, 823, and 824 are connected through their ends. One of the first through fourth combustion parts 821, 822, 823, and 824 are substantially perpendicular to adjacent another thereof.

Since the first through fourth combustion parts 821, 822, 823, and 824 constitute the combustion unit 820, the combustion unit 820 is tetragonal in a single loop.

Connection portions of the first through fourth combustion parts 821, 822, 823, and 824 may be round to improve the flow of a mixed gaseous fuel.

One of the first through fourth combustion parts 821, 822, 823, and 824 is connected to the supply part 810. In the present embodiment, the first combustion unit 821 is connected to the supply part 810.

Particularly, the supply part 810 is connected to the middle of the first combustion unit 821. Alternatively, the supply part 810 may be connected to a position of the first combustion unit 821 spaced apart from both ends of the first combustion unit 821. Thus, a mixed gaseous fuel introduced into the first combustion unit 821 flows to the ends of the first combustion unit 821 to reduce time required to spread to the whole of the combustion unit 720.

An outer portion of each of the first through fourth combustion parts 821, 822, 823, and 824 is provided with one or more outer flame holes 833.

The outer flame holes 833 are normal to side surfaces of the first through fourth combustion parts 821, 822, 823, and 824.

An inner portion of each of the first through fourth combustion parts 821, 822, 823, and 824 is provided with one or more first inner flame holes 831 and one or more second inner flame holes 832.

The first inner flame holes 831 are tilted from the normal direction to the side surfaces of the first through fourth combustion parts 821, 822, 823, and 824. The second inner flame holes 832 are normal to the side surfaces of the first through fourth combustion parts 821, 822, 823, and 824.

The first inner flame holes 831 are adjacent to the connection portions of the first through fourth combustion parts 821, 822, 823, and 824. Thus, each of the first through fourth combustion parts 821, 822, 823, and 824 includes at least one of the first inner flame holes 831 on each of its both sides. The second inner flame holes 832 are disposed between the first inner flame holes 831.

The inner portion of the first inner flame hole 831 in any one of the first through fourth combustion parts 821, 822, 823, and 824 is tilted toward the connection portion, and the first inner flame hole 831 adjacent to the first inner flame hole 831 having the tilted inner portion has an inner portion that is tilted away from the connection portion, so as to prevent flames from interfering or being in contact with each other at the connection portions of the first through fourth combustion parts 821, 822, 823, and 824.

Particularly, the inner portion of the first inner flame hole 831 on the left side of the first combustion part 821 is tilted to the connection portion, and the inner portion of the first inner flame hole 831 of the second combustion part 822 adjacent to the first combustion part 821 is tilted away from the connection portion.

Although the supply part 810 is connected to the middle of the first combustion part 821 in the present embodiment, the supply part 810 may be connected to the connection portion between the first through fourth combustion parts 821, 822, 823, and 824.

Figure 10:
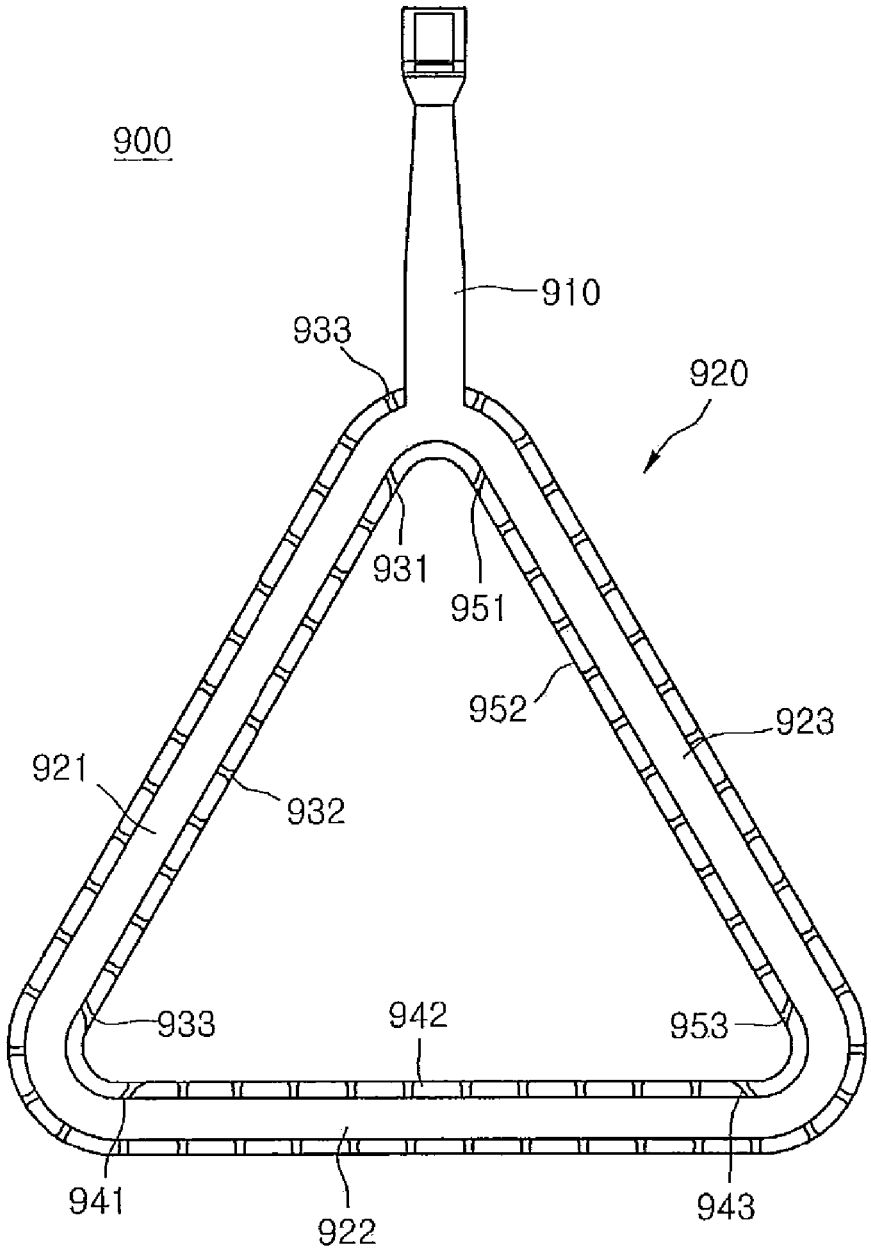
FIG. 10 is a bottom view illustrating an oven burner according to another embodiment.

FIG. 10 is a bottom view illustrating an oven burner 900 according to another embodiment.

Referring to FIG. 10, the oven burner 900 includes a supply part 910 and a combustion unit 920.

The combustion unit 920 includes first through third combustion parts 921, 922, and 923 that are connected to each other through their ends. One of the first through third combustion parts 921, 922, and 923 forms an acute angle with adjacent another one thereof.

That is, since the first through third combustion parts 921, 922, and 923 constitute the combustion unit 920, the combustion unit 920 is triangular in a single loop.

The supply part 910 is connected to one of connection portions between the first through third combustion parts 921, 922, and 923. In the present embodiment, the supply part 910 is connected to the connection portion between the first and third combustion parts 921 and 923.

Ends of an inner portion of the first combustion part 921 are respectively provided with at least one first inner flame hole 931 and at least one third inner flame hole 933 that are tilted from a normal direction to a side surface of the first combustion part 921. A plurality of second inner flame holes 932 normal to the side surface of the first combustion part 921 are disposed between the first inner flame hole 931 and the third inner flame hole 933.

Ends of an inner portion of the second combustion part 922 are respectively provided with at least one first inner flame hole 941 and at least one third inner flame hole 943 that are tilted from a normal direction to a side surface of the second combustion part 922. A plurality of second inner flame holes 942 normal to the side surface of the second combustion part 922 are disposed between the first inner flame hole 941 and the third inner flame hole 943.

Ends of an inner portion of the third combustion part 923 are respectively provided with at least one first inner flame hole 951 and at least one third inner flame hole 953 that are tilted from a normal direction to a side surface of the third combustion part 923. A plurality of second inner flame holes 952 normal to the side surface of the third combustion part 923 are disposed between the first inner flame hole 951 and the third inner flame hole 953.

Particularly, inner portions of the first inner flame hole 931 and the first inner flame hole 951 extend away from the connection portion between the first combustion part 921 and the third combustion part 923 to efficiently generate flames and prevent flame interference. That is, the inner portions of the first inner flame holes 931 and 951 are tilted to the second inner flame holes 932 and 952 from the normal direction to the side surfaces of the first and third combustion parts 921 and 923.

An inner portion of the third inner flame hole 933 is tilted to the connection portion between the first combustion part 921 and the second combustion part 922, and an inner portion of the first inner flame hole 941 of the second combustion part 922 is tilted away from the connection portion between the first combustion part 921 and the second combustion part 922, so as to prevent flames from interfering or being contact with each other in the connection portion between the first combustion part 921 and the second combustion part 922.

An inner portion of the third inner flame hole 953 is tilted to the connection portion between the third combustion part 923 and the second combustion part 922, and an inner portion of the third inner flame hole 943 is tilted away from the connection portion between the third combustion part 923 and the second combustion part 922, so as to prevent flames from interfering or being contact with each other in the connection portion between the third combustion part 923 and the second combustion part 922.

Figure 11:
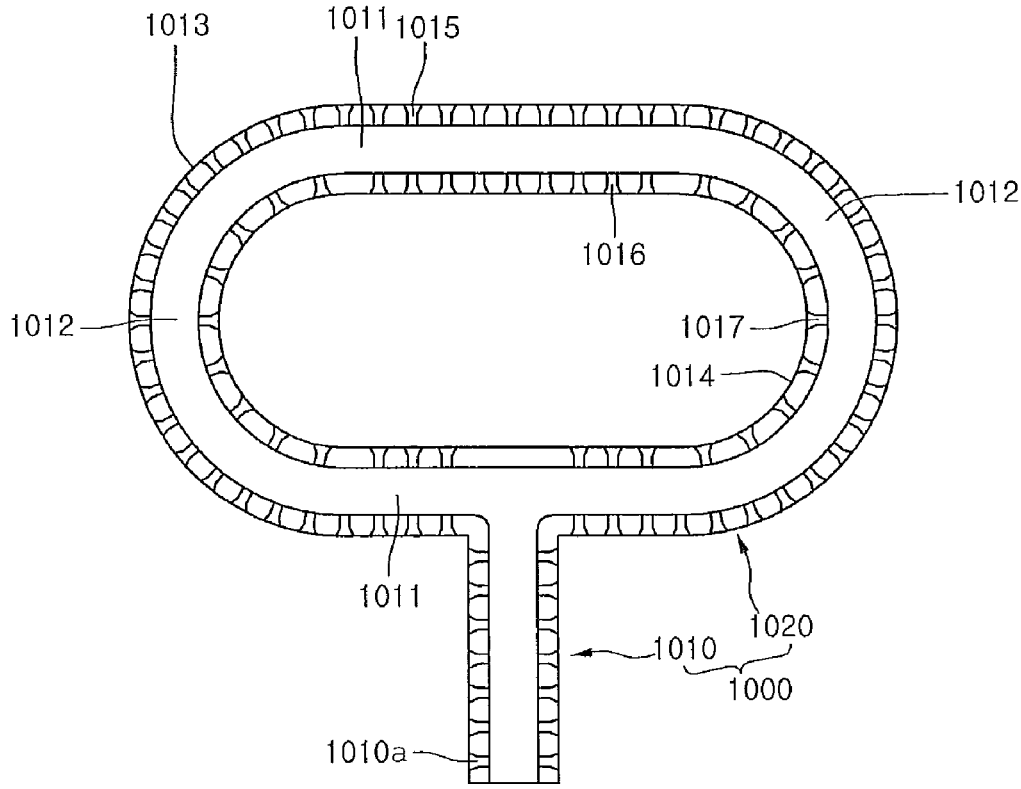
FIG. 11 is a bottom view illustrating an oven burner according to another embodiment.

FIG. 11 is a bottom view illustrating an oven burner 1000 according to another embodiment.

Hereinafter, the oven burner 1000 will now be described. A description of the same parts as the embodiment of FIGS. 3 to 5 will be omitted.

Referring to FIG. 11, the oven burner 1000 includes first and second combustion parts 1010 and 1020 that are parallel to the bottom of a cavity. The first combustion part 1010 receives a gaseous fuel mixed with air from a nozzle (not shown). That is, the first combustion part 1010 burns a mixed gaseous fuel and functions as the supply parts of the previous embodiments.

The first combustion part 1010 has at least one straight portion. In the present embodiment, the first combustion part 1010 has a straight shape as a whole.

The second combustion part 1020 has a closed curve shape as a whole. For example, the second combustion part 1020 may be substantially oval, but is not limited thereto. To uniformly heat food, the second combustion part 1020 may be symmetrical with respect to a line halving the ceiling 212 of FIG. 1 of the cook chamber 211 of FIG. 1.

The second combustion part 1020 may include a plurality of straight portions 1011 parallel to each other, and a plurality of curve portions 1012 connecting the straight portions 1011.

One of the straight portions 1011 is connected to the first combustion part 1010. The first combustion part 1010 may extend perpendicularly to one of the straight portions 1011. A position of the straight portion 1011 connected to the first combustion part 1010 functions as a distribution part. Thus, the second combustion part 1020 includes a plurality of branches extending from both sides of the straight portion 1011 functioning as a distribution part, and the branches are connected to each other through their ends.

Flame holes 1010*a* are disposed on both sides of the first combustion part 1010. Alternatively, a single flame hole may be disposed on each side of the first combustion part 1010.

The second combustion part 1020 includes an outer portion 1013 and an inner portion 1014. The outer portion 1013 is provided with one or more flame holes 1015.

The inner portion 1014 is provided with one or more flame holes 1016 and one or more flame holes 1017. The flame holes 1016 are disposed in the straight portions 1011, and the flame holes 1017 are disposed in the curve portions 1012.

A distance between the flame holes 1017 is greater than a distance between the flame holes 1016 to prevent flame interference at the inner portion 1014 of the curve portions 1012. The distance between the flame holes 1016 is the same as a distance between the flame holes 1015.

According to the present embodiment, the first combustion part 1010 functions as the supply parts of the previous embodiments. In addition, the supply parts of the previous embodiments may be provided with flame holes, so that the supply parts can function as combustion parts.

According to the embodiments, since the inner part and the outer part of the combustion unit generate flames, the areas of the flames are increased to quickly heat food.

Since a flame is not generated in the middle of the combustion unit, heat is prevented from being collected in the middle of food.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking device comprising:

a cavity providing a cooking chamber; and a burner provided at the cooking chamber in the cavity, the burner heating food in the cooking chamber, wherein the burner includes:

a supply part where a gaseous fuel mixed with air flows; and a combustion unit connected to the supply part to receive the mixed gaseous fuel and to burn the received mixed gaseous fuel flowing within the combustion unit, wherein the combustion unit has a single loop shape, wherein the combustion unit further comprises an inner part provided with a plurality of flame holes for generating flames and an outer part provided with a plurality of flame holes for generating flames, at least one of the inner part and the outer part comprises:

an upper case;

a lower case coupled to the upper case; and a plurality of gaps disposed between at least two adjacent flame holes, the plurality of gaps being configured to transfer a flame between the two adjacent flame holes, at least a portion of the lower case being spaced apart from the upper case to form the plurality of gaps, wherein the flame holes of the inner part comprise a first flame hole tilted from a normal line to the inner part, and a second flame hole normal to the inner part.

2. The cooking device according to claim 1, wherein the combustion unit is horizontally disposed in the cavity.

3. The cooking device according to claim 1, wherein the supply part extends horizontally from the combustion unit.

4. The cooking device according to claim 1, wherein the combustion unit is round as a whole.

5. The cooking device according to claim 4, wherein a distance between at least two of the flame holes of the inner part is greater than a distance between the flame holes of the outer part.

6. The cooking device according to claim 1, wherein the supply part extends from the combustion unit in a tangential direction of the combustion unit.

7. The cooking device according to claim 6, wherein the first flame hole is adjacent to a portion connected to the supply part.

8. The cooking device according to claim 1, wherein the combustion unit comprises a plurality of combustion parts, each of which has an end that is connected to the end of the adjacent combustion part.

9. The cooking device according to claim 8, wherein the combustion parts have at least one straight portion.

10. The cooking device according to claim 8, wherein each combustion part is bent one or more times.

11. The cooking device according to claim 8, wherein the supply part is connected to one of the combustion parts.

12. The cooking device according to claim 8, wherein the supply part is connected to a connection portion between two of the combustion parts.

13. The cooking device according to claim 1, wherein the supply part is provided with a plurality of flame holes.

14. A burner comprising:

a supply part where a gaseous fuel mixed with air flows; and a combustion unit connected to the supply part to receive the mixed gaseous fuel and to burn the received mixed gaseous fuel flowing within the combustion unit, wherein the combustion unit includes an inner part provided with a plurality of flame holes an outer part provided with a plurality of flame holes, the outer part being spaced apart from the inner part to surround the inner part, wherein the combustion unit further comprises:

an upper case;

a lower case coupled to the upper case; and a plurality of gaps disposed between at least two adjacent flame holes, the plurality of gaps being configured to transfer a flame between the two adjacent flame holes, wherein at least a portion of the lower case is spaced apart from the upper case to form the plurality gaps, wherein the flame holes of the inner part include first flame holes which project the flame in an inner direction of the inner part and the flame holes of the outer part include second flame holes which project the flame in an outer direction of the outer part, and wherein a distance between at least two of the first flame holes is greater than a distance between the corresponding second flame holes.

15. The burner according to claim 14, wherein the supply part has at least one straight portion.

* * * * *